US005704762A

United States Patent [19]

Schultze

[11] Patent Number: 5,704,762

[45] Date of Patent: Jan. 6, 1998

[54] CERAMIC-TO-METAL STATOR VANE ASSEMBLY

[75] Inventor: Richard W. Schultze, Phoenix, Ariz.

[73] Assignee: AlliedSignal Inc., Morris Township, N.J.

[21] Appl. No.: 148,812

[22] Filed: Nov. 8, 1993

[51] Int. Cl.[6] ..... F01D 9/04

[52] U.S. Cl. ..... 415/200; 415/209.3; 415/209.4

[58] Field of Search ..... 415/200, 209.3, 415/209.4, 211.2

[56] References Cited

U.S. PATENT DOCUMENTS

| | | | |
|---|---|---|---|
| 2,488,875 | 11/1949 | Morley | 253/65 |
| 2,834,537 | 5/1958 | Neary . | |
| 3,079,128 | 2/1963 | Burge | 415/200 |
| 3,392,958 | 7/1968 | Penny et al. | 415/200 |
| 3,708,242 | 1/1973 | Bruneau et al. . | |
| 3,836,282 | 9/1974 | Mandelbaum et al. . | |
| 3,849,023 | 11/1974 | Klompas . | |
| 3,867,065 | 2/1975 | Schaller et al. . | |
| 3,966,353 | 6/1976 | Booher, Jr. et al. . | |
| 4,009,969 | 3/1977 | Kadera et al. . | |
| 4,245,954 | 1/1981 | Glenn | 415/200 |
| 4,643,636 | 2/1987 | Libertini et al. | 415/138 |
| 4,768,924 | 9/1988 | Carrier et al. . | |
| 5,062,767 | 11/1991 | Worley et al. | 415/200 |
| 5,074,749 | 12/1991 | Fouillot et al. . | |
| 5,074,752 | 12/1991 | Murphy et al. . | |
| 5,078,576 | 1/1992 | Hayton | 415/200 |
| 5,105,625 | 4/1992 | Bell, III et al. . | |
| 5,129,783 | 7/1992 | Hayton . | |
| 5,149,250 | 9/1992 | Plemmon's et al. | 415/209.3 |
| 5,236,304 | 8/1993 | Charbonnel et al. | 415/209.3 |

FOREIGN PATENT DOCUMENTS

| | | | |
|---|---|---|---|
| 2 106 561 A | 5/1972 | France . | |
| 0041903 | 2/1987 | Japan | 415/209.3 |
| 0807231 | 1/1959 | United Kingdom | 415/209.3 |
| 2 039 331 | 8/1980 | United Kingdom . | |
| 2 071 776 | 9/1981 | United Kingdom . | |
| 2 234 299 | 1/1991 | United Kingdom . | |

OTHER PUBLICATIONS

Artilce from Apr. 1985 Power Transmission Design entitled "Tolerance Rings Improve PT Performance and Simplify Servicing".

*Primary Examiner*—Edward K. Look
*Attorney, Agent, or Firm*—Jerry J. Holden

[57] ABSTRACT

A stator vane assembly for a gas turbine engine that includes a plurality of circumferentially spaced ceramic vanes, each of which has an inner and outer ceramic shroud, and a ceramic post extending from one of the shrouds, and a metallic platform having a plurality of circumferentially spaced sleeves. A tolerance ring is mounted in each of the sleeves and then the ceramic posts are pressed into the rings. The assembly is then ready to be mounted within the engine. A method for assembling these components to form the stator assembly is also described.

5 Claims, 3 Drawing Sheets

CERAMIC-TO-METAL STATOR VANE ASSEMBLY

TECHNICAL FIELD

This invention relates to gas turbine engines, and in particular, to a stator vane assembly having ceramic stator vanes mounted to a metallic support structure.

BACKGROUND OF THE INVENTION

It has long been recognized that the efficiency and performance of gas turbine engines could be improved by increasing the temperature of the gas through the turbine section. Historically, these temperatures have been limited by the materials, usually high temperature steel or nickel alloy, used to form the first stage stator vanes. To permit higher gas temperatures it has been proposed to form the first stage stator vanes from a high density, high strength, hot pressed, silicon nitride, or silicon carbide ceramic which can withstand higher temperatures than steels or nickel alloys. However, the use of ceramic stator vanes necessitates a ceramic-to-metal interface at which the difference in thermal expansion between the ceramic vane and the metallic support structure must be accommodated so that the vanes remain fixed relative to the structure despite temperature changes in the gas. It also necessitates that the ceramic-to-metal interface prevent the vanes from twisting when subjected to aerodynamic loads.

Thus, there is a need for a stator vane assembly in a gas turbine engine in which ceramic stator vanes are mounted to a metallic support structure in such a way so as accomodate the thermal mismatch between the ceramic and metallic.

SUMMARY OF THE INVENTION

An object of the present invention is to provide a stator vane assembly for gas turbine engines having ceramic stator vanes.

Another object of the present invention is to provide a method for mounting ceramic stator vanes in a gas turbine engine.

The present invention achieves these objectives by providing a stator vane assembly that includes a plurality of circumferentially spaced ceramic vanes, each of which has a inner and outer ceramic shroud, and a ceramic post extending from one of the shrouds, and a metallic platform having a plurality of circumferentially spaced sleeves. A tolerance ring is mounted in each of the sleeves and then the ceramic posts are pressed into the rings. The assembly is then mounted within a gas turbine engine. A method for assembling these components to form the stator assembly is also described.

DESCRIPTION OF THE PREFERRED EMBODIMENT

Figure 1:
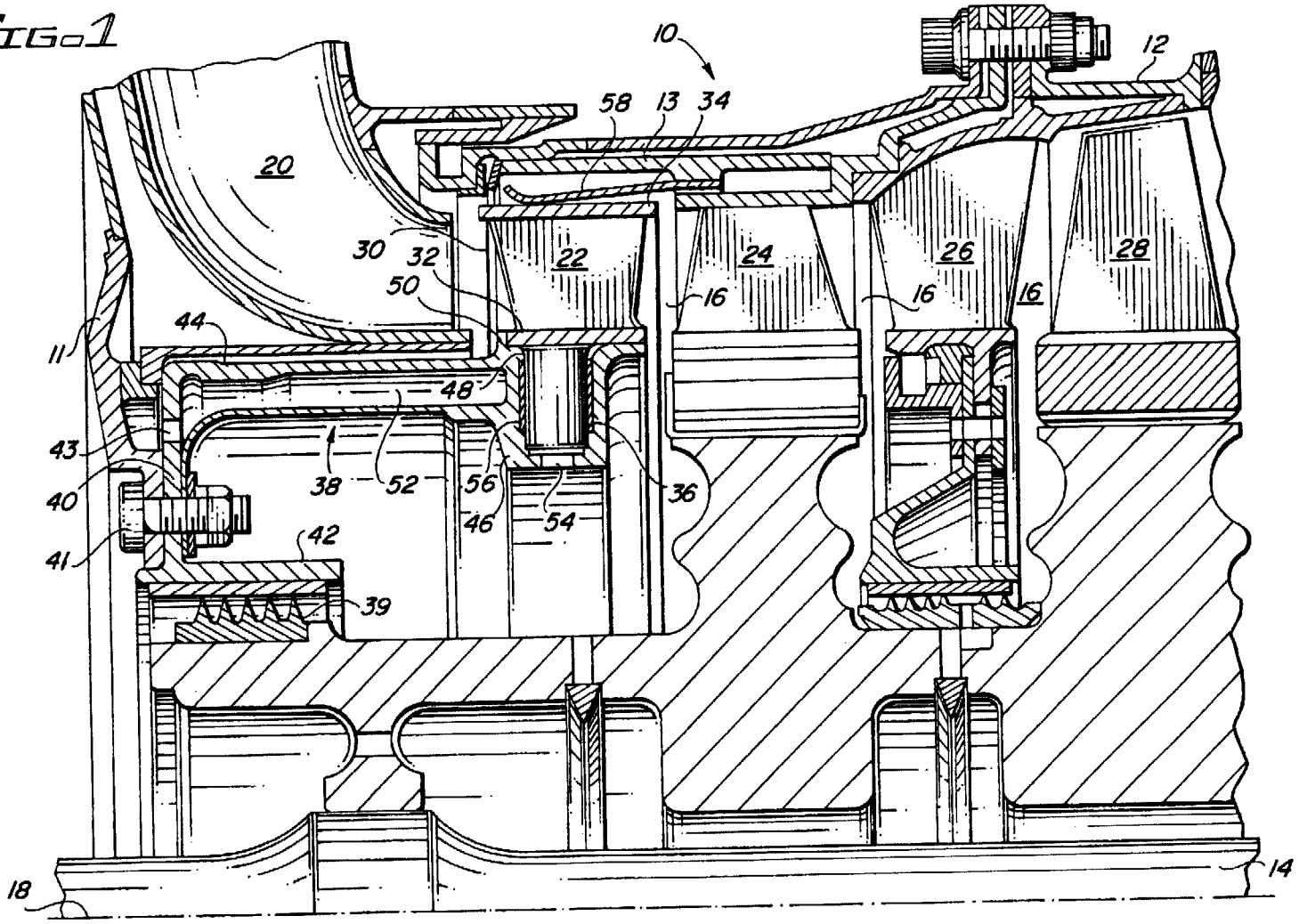
FIG. 1 is a cross sectional view of a portion of a gas turbine engine having a stator vane assembly contemplated by the present invention.

FIG. 1 shows a partial view of the turbine section 10 of a gas turbine engine. The turbine section 10 is conventional in that it has a nonrotating metallic casing 12 that circumscribes a rotating shaft 14 to define a flow path 16 therebetween. The casing 12 is comprised of a plurality of walls only some of which, such as 11 and 13, are shown. The flow path 16 extends axially, parallel to the engine's center line 18, from the combustor 20 towards the engine's exhaust, not shown. Operably disposed within the flow path 16 are a plurality of stator assemblies 22, 26 and rotor assemblies 24, 28. The stator assemblies 22, 26 are mounted to the metallic casing 12 and the rotor assemblies 24, 28 are mounted to the shaft 14. The hot gas exiting the combustor 20 is expanded across the turbine section 10 causing the rotor assemblies 24, 28 and hence the shaft 14 to rotate.

The stator assembly 22 includes a plurality of stator vanes 30. Each vane 30 is bounded radially, relative to the engine centerline 18, by an inner shroud 32 and an outer shroud 34. Extending radially inward from the inner shroud 32 is a post 36. The post 36 is preferably cylindrical, though other shapes are contemplated to work as effectively. The vane 30, shrouds 32, 34, and post 36 are all integrally formed from a ceramic such as silicon carbide or silicon nitride. In addition, the vanes 30 are formed with the post 36 off center from the radial centerline of the vane 30.

Figure 2:
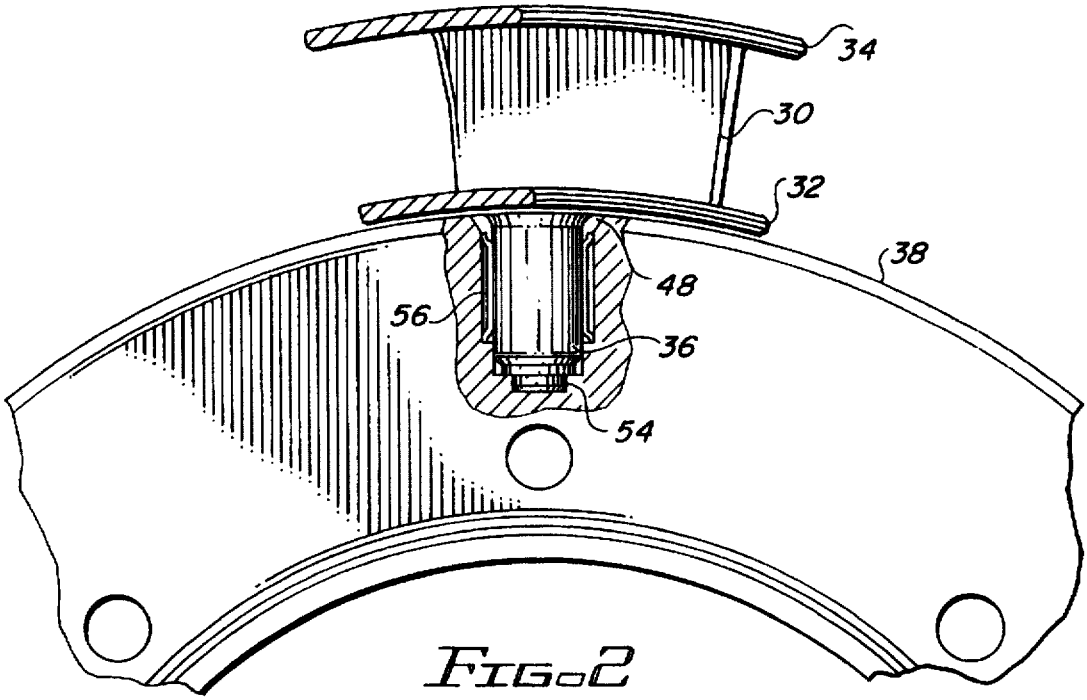
FIG. 2 is a front view, with a cutaway portion, of the stator vane assembly of FIG. 1.
Figure 3:
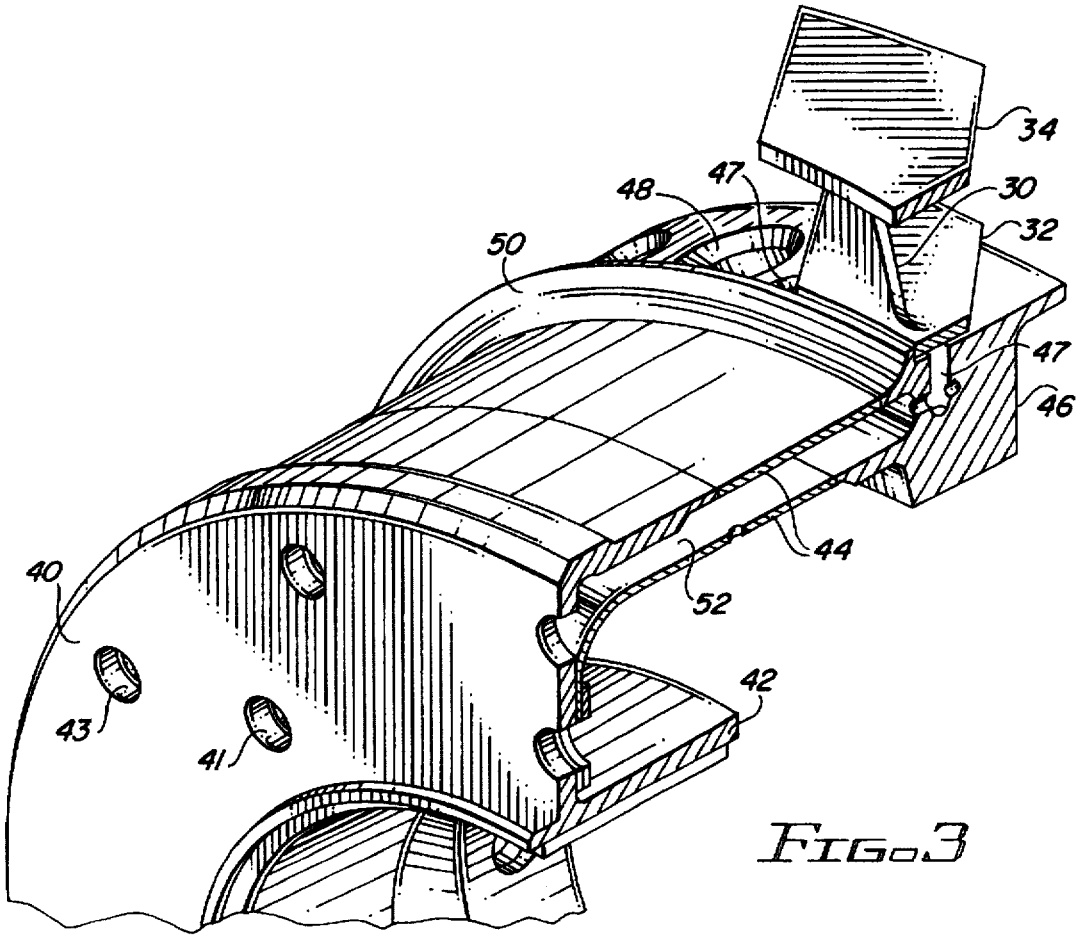
FIG. 3 is perspective view of a cross-section of the annular wall portion of the stator vane assembly of FIG. 1.

The stator assembly 22 further includes an annular vane holder 38, which in the preferred embodiment is illustrated in FIGS. 1–3. However, the present invention contemplates that its shape and configuration can vary greatly depending on the particular engine in which it is mounted, and on the particular stator assembly receiving the ceramic vanes. The vane holder 38 has a radially extending annular wall 40 having bolt holes 41 and cooling air holes 43. Extending axially from the wall 40 toward the rear of the engine are two radially spaced walls 42 and 44. The inner wall 42 has a flat inner surface that, after mounting, abuts a rotating seal 39. The outer wall 44 extends further than the inner wall 42 and has at its axial end a platform 46 having a plurality of circumferentially spaced sleeves 48 extending radially therethrough. An annular lip 50 extends radially outward from the platform 46, adjacent the sleeves 48. The outer wall 44 is hollow to reduce its weight, and also to provide passages 52 that receive cooling air from the holes 43. Referring to FIG. 3, from the passages 52 the cooling air flows through bores 47, over the surface of the platform 46, and then into the sleeves 48.

To mount a stator vane 30 to the platform 46, a metallic button 54 is placed at the bottom of a sleeve 48. The button 54 plugs the bottom of the sleeve 48, thereby reducing the leakage of cooling air. It is also used for pressing the vane 30 out of the sleeve 48 during disassembly. A tolerance ring 56 is compressed and placed in the sleeve 48. The post 36 is then pressed into the tolerance ring 56. It is the compression of the tolerance ring 56 that holds the vane in place. Importantly, the vanes 30 and vane holder 38 must be configured so that after mounting, the inner shroud 32 abuts the lip 50. This will prevent the vane 30 from rotating should the tolerance ring 56 fail. The direction of rotation of the vane 30, when such a failure occurs, can be controlled by the off-center positioning of the post 36. Once each of the vanes 30 has been mounted to the platform 46, the platform 46 is bolted to the wall 11 and a leaf seal 58 is pressed between the outer shroud 34 and the wall 13 to prevent leakage of gas across the top of the shrouds 34.

The tolerance ring 56 is commercially available and consists of a strip of high temperature spring steel, preferably Hastalloy-C or Inconel 4005, which has been formed into a ring with a small gap between the ends. When installed between the post 36 and the inner surface of the sleeve 48, the tolerance ring 56 acts as an elastic shim to position and frictionally hold these two parts together and also compensates for the difference in radial thermal growth between the metallic sleeve 48 and ceramic post 36. The tolerance ring 56 has uniformly spaced corrugations and holes, not shown, that allow the cooling air to flow between the ring 56 and the post 36.

Figure 4:
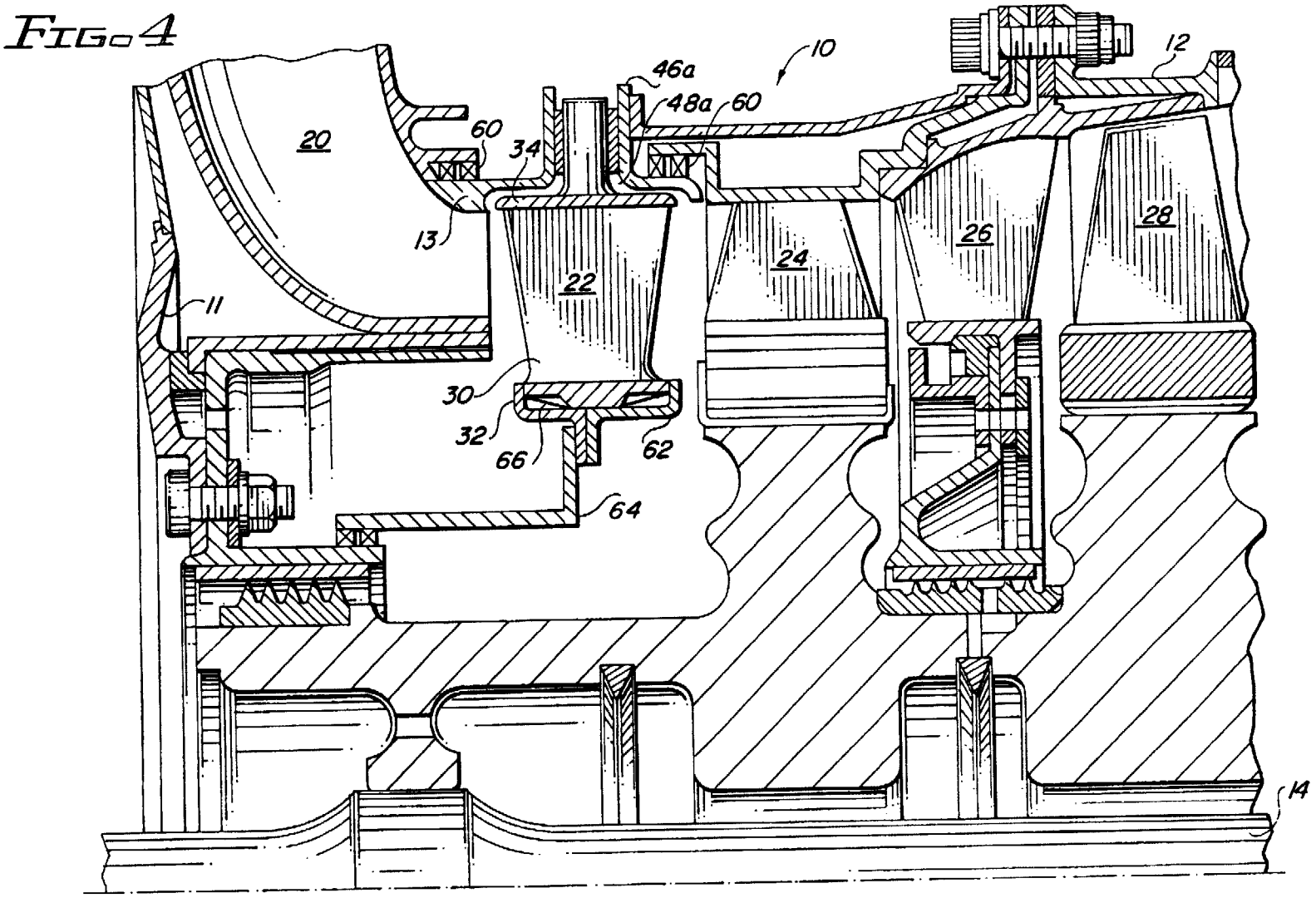
FIG. 4 is an alternative embodiment of the stator vane assembly of FIG. 1.

FIG. 4 shows an alternative embodiment of the stator vane assembly 22 in which a platform 46*a*, having a plurality of cirumferentially disposed sleeves 48*a*, is integrated into the casing wall 13. This integration requires piston or brush seals 60 to prevent leakage between the platform 46*a* and the wall 13. In this embodiment, the post 36 extends from the outer shroud 34. An annular sealing structure 62 axially and radially bounds the inner shroud 32. The sealing structure 62 is coupled to an annular support member 64 which is mounted to the casing 12. A leaf spring 66 is disposed between the inner shroud 32 and the sealing structure 62.

Thus, in the stator vane assembly 22 the vanes 30 remain fixed relative to the casing 12 despite temperature changes in the gas. The vanes are also sufficiently supported to withstand aerodynamic loads associated with first stage stators in gas turbine engines.

Various modifications and alterations to the above described embodiments will be apparent to those skilled in the art. Accordingly, this description of the invention should be considered exemplary and not as limiting the scope and spirit of the invention as set forth in the following claims.

What is claimed is:

1. A stator vane assembly for a gas turbine engine having a stationary casing circumscribing a rotating shaft, said stator vane assembly comprising:

a plurality of circumferentially spaced ceramic vanes, each of said vanes having a first and second ceramic shroud, and having a ceramic post extending from said first shroud;

a metallic platform having a plurality of circumferentially spaced sleeves, each of said sleeves are open at both ends and receiving one of said posts;

a plurality of compliant members, each of said compliant members are tolerance rings and disposed between one of said ceramic posts and its corresponding sleeve; and metallic buttons placed in each of said sleeves to plug one of said open ends.

2. The stator vane assembly of claim 1 further comprising a seal disposed between said second shroud and said casing.

3. A method for mounting ceramic stator vanes in a gas turbine engine having a metallic casing circumscribing a metallic shaft, comprising the steps of:

providing ceramic stator vanes having a ceramic first shroud, a ceramic second shroud, and a ceramic post extending from said first shroud;

providing a metallic platform having a plurality of circumferentially spaced sleeves extending therethrough;

placing a compressed tolerance ring in each of said sleeves;

pressing said posts of said vanes into said tolerance rings; and plugging one end of said sleeves with a metallic button.

4. The method of claim 3 further comprising the step of mounting said platform to said casing.

5. The method of claim 4 further comprising the step of mounting a seal between said casing and said second shroud.

* * * * *